US007744189B2

(12) United States Patent
Sayama

(10) Patent No.: US 7,744,189 B2
(45) Date of Patent: Jun. 29, 2010

(54) LIQUID EJECTING APPARATUS

(75) Inventor: Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 180 days.

(21) Appl. No.: 12/178,362

(22) Filed: Jul. 23, 2008

(65) Prior Publication Data

US 2009/0027440 A1 Jan. 29, 2009

(30) Foreign Application Priority Data

Jul. 25, 2007 (JP) ..... 2007-192877

(51) Int. Cl.
*B41J 29/393* (2006.01)

(52) U.S. Cl. ..... 347/19; 347/41

(58) Field of Classification Search ..... 347/67–72, 347/9–11, 19; 358/504
See application file for complete search history.

(56) References Cited

U.S. PATENT DOCUMENTS 6,491,373 B1 * 12/2002 Fujita et al. ..... 347/41
6,726,303 B2 * 4/2004 Otsuki ..... 347/19
6,739,699 B1 * 5/2004 Sender et al. ..... 347/43
7,377,613 B2 * 5/2008 Yamazaki et al. ..... 347/19

FOREIGN PATENT DOCUMENTS

JP 11-058729 3/1999

* cited by examiner

*Primary Examiner*—Lamson D Nguyen
(74) *Attorney, Agent, or Firm*—Workman Nydegger

(57) ABSTRACT

A controller of a liquid ejecting apparatus forms first inspection patterns on a medium in a head moving direction while moving a liquid ejecting head in a forward direction. Corresponding second inspection patterns are formed on the medium in the head moving direction while moving the liquid ejecting head in a backward direction. When forming the patterns, the controller sets a voltage of a drive pulse corresponding to a preferable combination of the first and second inspection patterns, as a normally-used voltage used for normal forming. The controller differentiates the voltages of the drive pulses used for forming the inspection pattern for every combination of the first and second inspection patterns. The second inspection patterns correspond to the first inspection patterns at timings when positions of the second inspection patterns in the head moving direction are theoretically aligned with the positions of the first inspection patterns.

7 Claims, 6 Drawing Sheets

LIQUID EJECTING APPARATUS

CROSS REFERENCES TO RELATED APPLICATIONS

The present invention contains subject matter related to Japanese Patent Application No. 2007-192877 filed in the Japanese Patent Office on Jul. 25, 2007, the entire contents of which are incorporated herein by reference.

BACKGROUND

1. Technical Field

The present invention relates to a liquid ejecting apparatus such as an ink jet printer.

2. Related Art

A liquid ejecting apparatus is an apparatus including a liquid ejecting head and each of various liquids is ejected from this liquid ejecting head. As a typical example of this liquid ejecting apparatus, an image recording apparatus can be given, such as an ink jet printer (simply called a printer hereafter) including an ink jet type recording head (called simply a recording head), being a liquid ejecting head, constituted to perform recording by ejecting liquid ink as ink droplets, from this recording head to recording paper, etc, being an ejection target, and causing these ink droplets to impact on the ejection target to form dots. In recent years, this kind of liquid ejecting apparatus has been applied not only to image recording apparatuses but also to various kinds of manufacturing apparatuses such as display manufacturing apparatuses.

The aforementioned liquid ejecting head may be one equipped with, for example, piezoelectric elements as a pressure generating unit (driving source) for ejecting liquid. This piezoelectric element is constituted of a multilayer structure of a piezoelectric material made of PZT (lead zirconate titanate) and an electrode material, and elastic deformation or bending deformation of this piezoelectric element is made to occur by applying a voltage between a driving electrode and a common electrode. This piezoelectric element is joined to a diaphragm for partitioning a part of a pressure generation chamber that communicates with a nozzle opening, and by applying a drive signal in such a manner as drive deforming of the piezoelectric element, the diaphragm can be deformed. By deformation of this diaphragm, the volume of the pressure generation chamber is changed to allow pressure fluctuation to occur in the ink in the pressure generation chamber, and by controlling this pressure fluctuation, the liquid can be discharged (ejected) from the opening of the nozzle.

Then, in the liquid ejecting head using the aforementioned piezoelectric element as a driving source, an amount of the liquid ejected according to a voltage value of the drive signal is increased or decreased. Therefore, JP-A-11-58729 proposes a technique of setting an optimal voltage value as the drive signal for driving the piezoelectric element.

However, when the aforementioned printer is used over a long period of time, the piezoelectric element is gradually deteriorated, and its characteristics are changed (an amount of displacement is lowered). In this case, there is a possibility that even if the piezoelectric element is driven by the drive signal of the drive voltage set at the time of manufacture, the amount of the ejected ink or a flight speed of the ink does not coincide with a design value.

SUMMARY

An advantage of some aspects of the invention is that it provides a liquid ejecting apparatus capable of compensating a drive voltage so as to respond to a change in the characteristics of a pressure generating unit.

The present invention provides a liquid ejecting apparatus including a liquid ejecting head that ejects liquid from a nozzle opening by means of a pressure fluctuation of the liquid in a pressure generation chamber upon activation of the pressure generating unit; a drive signal generation unit that generates a drive signal including a drive pulse for driving the pressure generating unit; and a controller that controls ejection of the liquid by the liquid ejecting head, the controller forming a plurality of first inspection patterns on a medium in a head moving direction while moving the liquid ejecting head in a forward direction, forming a plurality of second inspection patterns on the medium in the head moving direction so as to correspond to the first inspection patterns formed on the medium while moving the liquid ejecting head in a backward direction, performing drive voltage reset processing for setting a voltage of a drive pulse at the time of forming patterns corresponding to a preferable combination of the first inspection patterns and the second inspection patterns formed in forming each inspection pattern as a normally-used voltage used for normal forming, differentiating the voltage of the drive pulse used for forming the inspection patterns for every combination of the first inspection patterns and the second inspection patterns in the aforementioned drive voltage reset processing, and forming the second inspection patterns corresponding to the first inspection patterns at timings when positions of the second inspection patterns in the head moving direction are theoretically aligned with the positions of the first inspection patterns.

Characteristics and some aspects of the invention other than those described above will become clear by reading the description of this specification, with reference to the appended drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
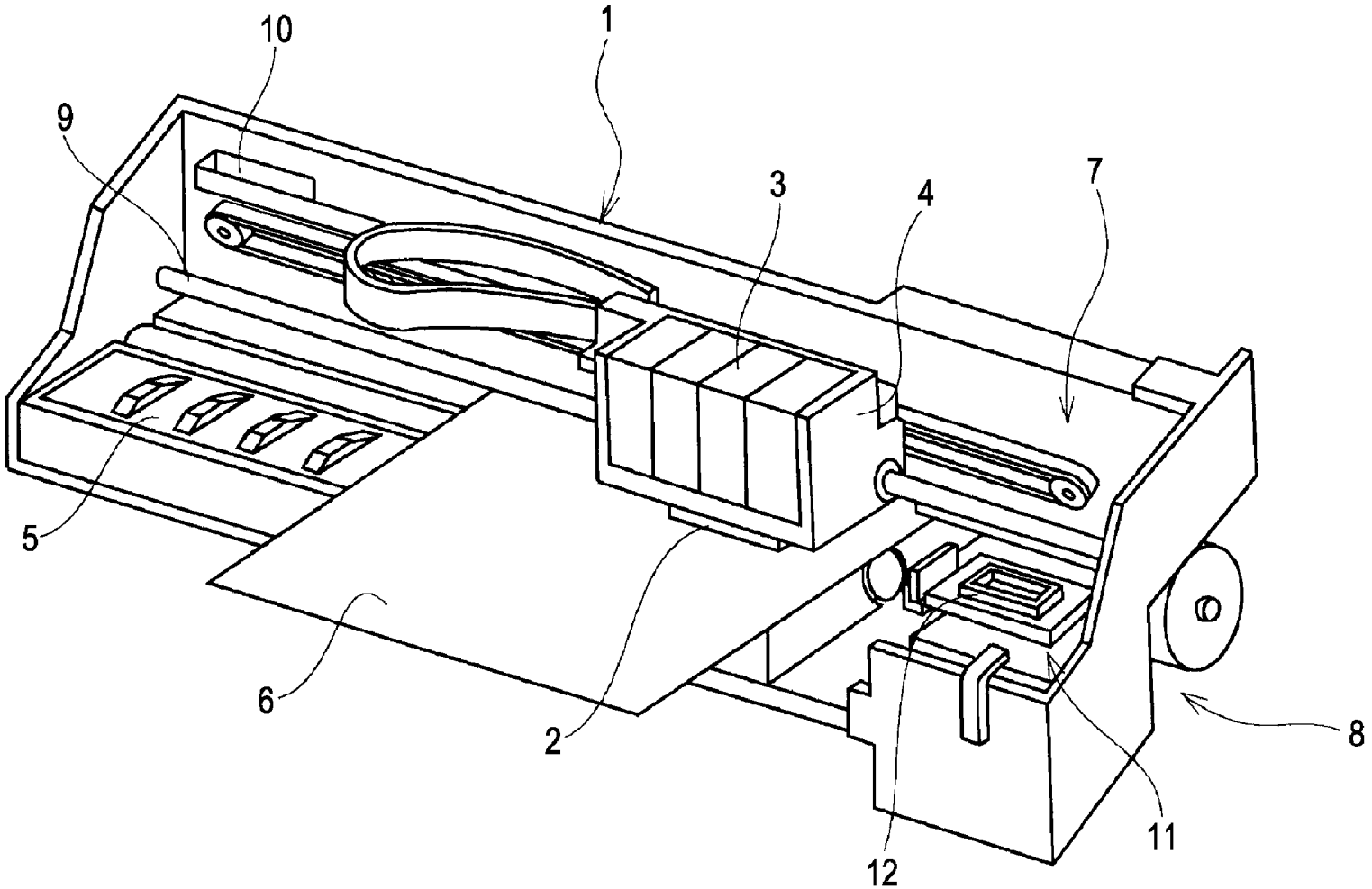
FIG. 1 is a perspective view explaining a structure of a printer.

The present invention provides a liquid ejecting apparatus including a liquid ejecting head that ejects liquid from a nozzle opening by a pressure fluctuation of the liquid in a pressure generation chamber upon activation of the pressure generating unit; a drive signal generation unit that generates a drive signal including a drive pulse for driving the pressure generating unit; and a controller that controls ejection of the liquid by the liquid ejecting head, the controller recording a plurality of first inspection patterns on a recording medium in a head moving direction while moving the liquid ejecting head in the forward direction; recording a plurality of second inspection patterns on the recording medium in the head moving direction so as to correspond to the first inspection patterns recorded on the recording medium; performing drive voltage reset processing for setting a voltage of a drive pulse at the time of recording patterns corresponding to a preferable combination of the first inspection patterns and the second inspection patterns recorded in recording of each inspection pattern, as a normally-used voltage used for normal recording; differentiating the voltage of the drive pulse used for recording the inspection patterns, for every combination of the first inspection patterns and the second inspection patterns in the aforementioned drive voltage reset processing; and recording the corresponding second inspection pattern at timings when positions of the second inspection patterns in the head moving direction are theoretically aligned with the positions of the first inspection patterns.

According to the above-described structure, a plurality of first inspection patterns are recorded on the recording medium in the head moving direction while moving the liquid ejecting head in the forward direction; a plurality of second inspection patterns are recorded on the recording medium in the head moving direction so as to correspond to the first inspection patterns recorded on the recording medium; the drive voltage reset processing is performed, in which the voltage of the drive pulse at the time of recording the pattern corresponding to the preferable combination of the first inspection patterns and the second inspection patterns recorded in each inspection pattern step, is set as the normally-used voltage used for normal recording; in this drive voltage reset processing, the voltage of the drive pulse used for recording the inspection patterns is differentiated for every combination of the first inspection patterns and the second inspection patterns; and the second inspection patterns are recorded, corresponding to the first inspection patterns at timings when the positions of the second inspection patterns are theoretically aligned with the positions of the first inspection patterns. Therefore, it is possible to respond to changes in characteristics of the pressure generating unit, and it is possible to maintain ejection characteristics such as an ejection amount and a flight speed of the liquid as designed.

In addition, preferably the normally-used voltage set at present is included in the voltage of the drive pulse which is different, for every combination of the first inspection patterns and the second inspection patterns.

In addition, it is preferable to adopt a structure in which the liquid ejecting head has a nozzle group formed by arranging nozzle openings in a plurality of rows in a direction orthogonal to the head moving direction, and each inspection pattern is constituted of longitudinal lines formed by simultaneous ejection of the liquid from the nozzle openings of the nozzle group, and a preferable combination is a combination in which the first inspection pattern and the second inspection pattern are arranged in a state in which they come closest to each other.

According to this structure, by visually judging a positional deviation between the longitudinal ruled lines as the first inspection patterns and the longitudinal ruled lines as the second inspection patterns formed on the recording medium, resetting of the drive voltage can be performed. Thus, the drive voltage can be easily reset without requiring a special separate structure.

In addition, it is preferable that a mode switching section capable of switching between a normal recording mode for performing a normal recording operation and a drive voltage resetting mode for performing drive voltage reset processing is provided, and the controller performs the drive voltage reset processing when the mode is switched to the drive voltage resetting mode by the mode switching section.

In addition, it is preferable to provide a timer section that counts elapsed time from the previous drive voltage setting time and switch the mode to the drive voltage resetting mode, under a condition that the elapsed time from the previous drive voltage setting time exceeds a judgment reference time.

Alternately, it may also be preferable that an ejection number counting section that counts the number of times that ejection of the liquid has been performed is provided and the mode switching section switches the mode to the drive voltage resetting mode, under a condition that a counted value by the ejection number counting section exceeds a judgment reference value.

Further, it may also be preferable that an instruction input section is provided, in which a mode switching instruction is inputted by a user and the mode switching section switches the mode to the drive voltage resetting mode, according to the mode switching instruction from the instruction input section.

Best mode for carrying out the invention will be explained hereafter, with reference to the drawings. Note that in the embodiments described hereafter, although various restrictions are made as specific examples of the present invention, the scope of the invention is not limited thereto, unless there is a description made to particularly restrict the invention. In addition, in the explanation given hereafter, an ink jet type recording apparatus (called a printer hereafter) is given as an example of a liquid ejecting apparatus of the present invention.

FIG. 1 is a perspective view showing a structure of a printer 1. This printer 1 is equipped with a recording head 2, being one kind of a liquid ejecting head, and basically includes: a carriage 4 having an ink cartridge 3 detachably installed therein; a platen 5 disposed below the recording head 2; a carriage moving mechanism 7 for reciprocally moving the carriage 4 (recording head 2) in a paper width direction of a recording paper sheet 6, being a kind of the recording medium, namely in a main scanning direction (in a head moving direction in this invention); and a paper feeding mechanism 8 for transporting the recording paper 6 in a sub-scanning direction, being a direction orthogonal to the main scanning direction. Note that it may also be preferable that the ink cartridge 3 is installed on the side of a casing of the printer 1, so that ink is supplied to the recording head 2 via an ink supply tube.

The carriage 4 is pivotably mounted on a guide rod 9 installed in the main scanning direction, and by an action of the carriage moving mechanism 7, the carriage 4 is moved in the main scanning direction along the guide rod 9. A position of the carriage 4 in the main scanning direction is detected by a linear encoder 10, and its detection signal, namely, an encoder pulse, is transmitted to a controller 41 (see FIG. 3) of a printer controller. Thus, the controller 41 can control recording operation (ejecting operation) performed by the recording head 2, while recognizing a scanning position of the carriage 4 (recording head 2) on the basis of the encoder pulse from the linear encoder 10.

A home position, being a reference point for scanning, is set in an end portion area outside the recording area (right side in FIG. 1) in a moving range of the carriage 4. At the home position in this embodiment, a capping member 11 for sealing a nozzle forming face of the recording head 2 (nozzle plate 21: see FIG. 2), and a wiper member 12 for wiping the nozzle forming face are disposed. Then, the printer 1 is capable of performing a so-called bidirectional recording for recording characters and an image on the recording paper 6 in both directions of forward movement whereby the carriage 4 (recording head 2) moves from the home position toward an end portion of an opposite side, and backward movement whereby the carriage 4 returns to the home position side from the end portion of the opposite side.

Figure 2:
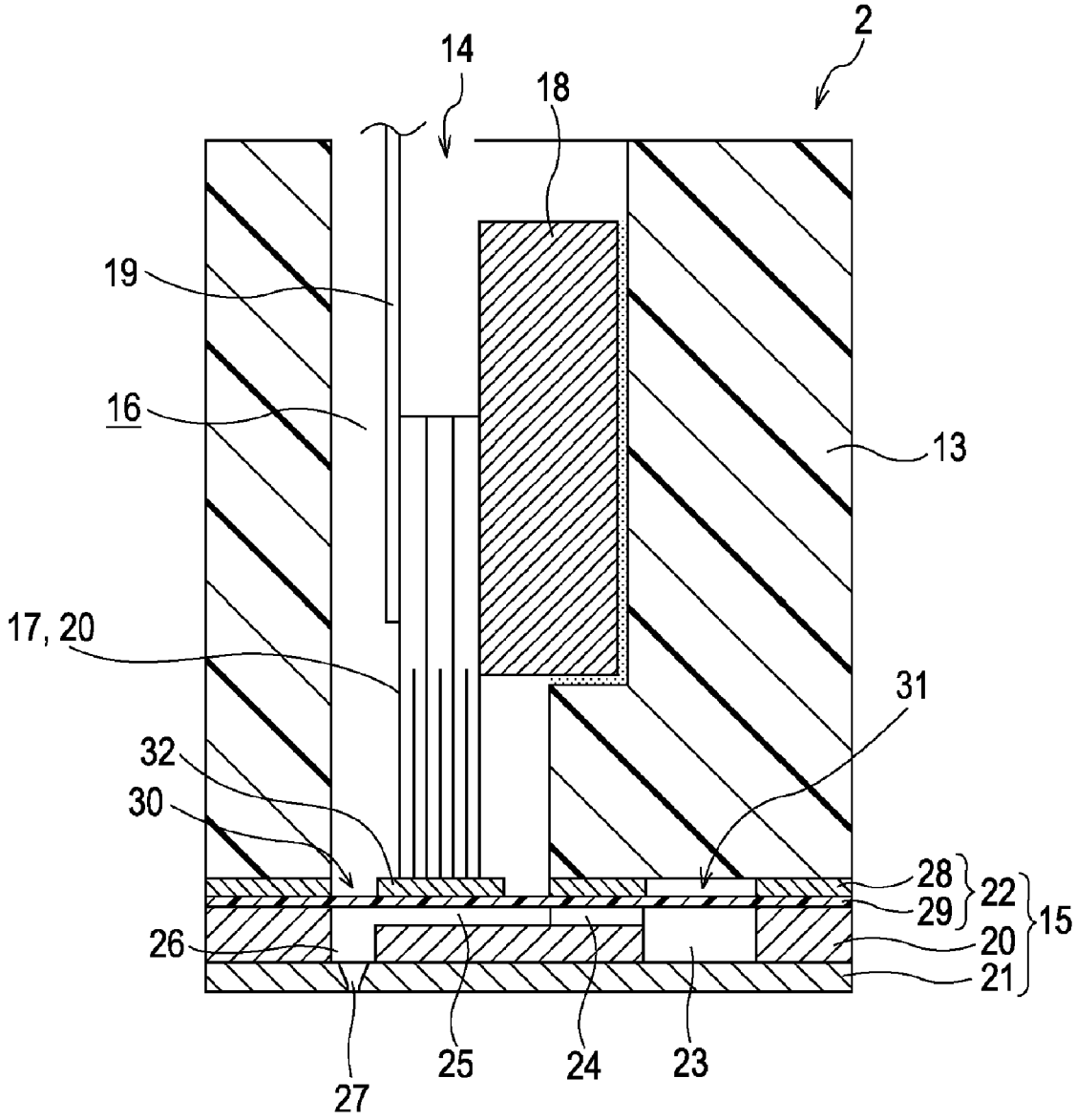
FIG. 2 is a sectional view of an essential portion explaining the structure of a recording head.

FIG. 2 is a sectional view of an essential part explaining the structure of the aforementioned recording head 2. The recording head 2 includes a case 13, an oscillator unit 14 stored in this case 13, a flow path unit 15 or the like that is joined to a bottom surface (tip end surface) of the case 13. The aforementioned case 13 is made of epoxy resin, for example, and a storage space 16 for storing the oscillator unit 14 is formed inside of this case 13. The oscillator unit 14 includes a piezoelectric element 17 that functions as a kind of a pressure generating unit, a fixing plate 18 having the piezoelectric element 17 fixed thereto, and a flexible cable 19 for supplying a drive signal, etc, to the piezoelectric element 17. The piezoelectric element 17 is formed to have a multilayer structure by performing cutting to form a wedge-like teeth shape, a piezoelectric plate in which a piezoelectric layer and an electrode layer are alternatively stacked, which is a piezoelectric element of a vertical oscillation mode extensible in a direction orthogonal to a layer-stacking direction.

The flow path unit 15 is constituted, so that a nozzle plate 21 is joined to one surface of a flow path forming substrate 20, and a diaphragm 22 is joined to the other surface of the flow path forming substrate 20. The flow path unit 15 includes a reservoir 23, an ink supply opening 24, a pressure generation chamber 25, a nozzle communication opening 26, and a nozzle opening 27. Then, an ink flow path extending from the ink supply opening 24 to the nozzle opening 27 through the pressure generation chamber 25 and the nozzle communication opening 26 is formed corresponding to each nozzle opening 27.

The aforementioned nozzle plate 21 is a thin metal plate made of stainless steel or the like on which a plurality of nozzle openings 27 are formed in a row at a pitch corresponding to a dot forming density (such as 360 dpi). A plurality of rows of nozzle openings 27 (nozzle rows (a kind of nozzle group in this invention)) are provided in this nozzle plate 21, and one nozzle row is constituted of, for example, 360 nozzle openings 27. In addition, the recording head 2 according to this invention is constituted so that four ink cartridges 3 can be mounted thereon, for storing ink (a kind of liquid in this invention) of different colors, specifically ink of four colors in total such as cyan (C), magenta (M), yellow (Y) and black (K), and four nozzle rows in total are formed on the nozzle plate 21, corresponding to these colors.

The aforementioned diaphragm 22 is formed so as to have a double structure in which an elastic film 29 is laminated onto a surface of a supporting plate 28. In this embodiment, a stainless steel plate, being a kind of a metal plate, is set as the supporting plate 28, and the diaphragm 22 is formed by using a combined plate material obtained by laminating a resin film onto the surface of the supporting plate 28 as the elastic film 29. A diaphragm section 30 is provided in this diaphragm 22, for changing the volume of the pressure generation chamber 25. In addition, a compliance section 31 is provided in this diaphragm 22, for sealing a part of the reservoir 23.

The aforementioned diaphragm section 30 is formed by partially removing the supporting plate 28 by an etching process, etc. Namely, the diaphragm section 30 is constituted of an island section 32, with a tip end surface of the piezoelectric element 17 joined thereto, and a thin elastic section formed by removing the supporting plate 28 around the island section 32. The aforementioned compliant section 31 is formed by removing the supporting section 28 of an area opposed to an opening surface of the reservoir 23 by an etching process or the like in the same way as the diaphragm section 30, and functions as a damper that absorbs pressure fluctuations of the liquid stored in the reservoir 23.

Then, since the tip end surface of the piezoelectric element 17 is joined to the island section 32, the volume of the pressure generation chamber 25 can be fluctuated by freely extending the end portion of the piezoelectric element 17. Pressure fluctuations occur in the ink in the pressure generation chamber 25, along with such volume fluctuations. Then, the recording head 2 ejects the ink from the nozzle opening 27 by using these pressure fluctuations.

Figure 3:
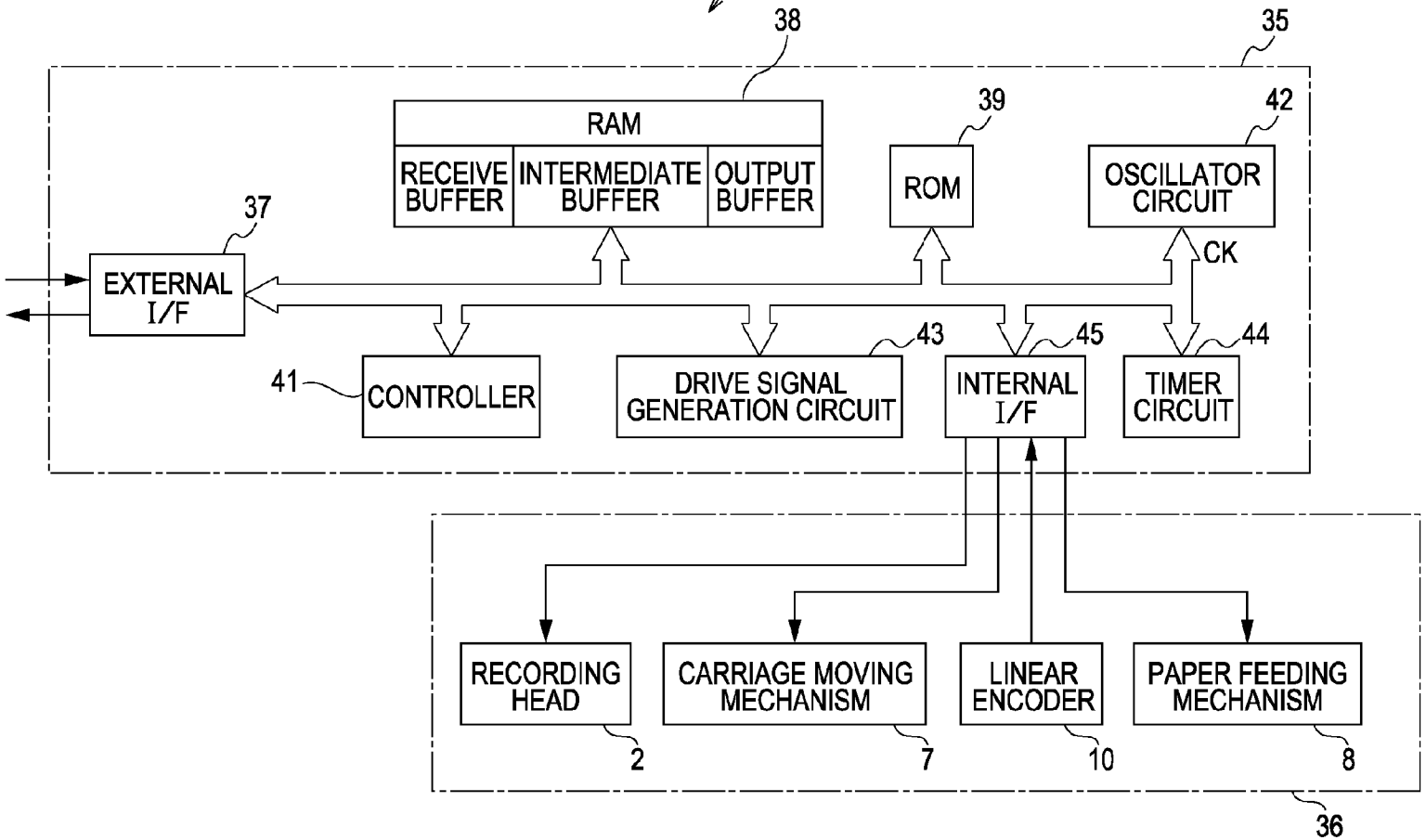
FIG. 3 is a block diagram explaining an electrical structure of the printer.

FIG. 3 is a block diagram showing an electrical configuration of the printer 1. The printer 1 includes: a printer controller 35 and a print engine 36. The printer controller 35 includes an external interface (external I/F) into which print data and the like is inputted from an external apparatus such as a host computer; a RAM 38 that stores each kind of data and the like; a ROM 39 that stores a control routine and the like for each kind of data processing; a controller 41 (a kind of control unit) that performs control of each section; an oscillator circuit 42 that generates a clock signal; a drive signal generation circuit 43 (drive signal generation unit) that generates a drive signal to be supplied to the recording head 2; a timer circuit 44 that functions as a timer unit; and an internal interface (internal I/F) 45 that performs input/output of the signal to/from the print engine 36. In addition, the print engine 36 is constituted of the recording head 2, the carriage moving mechanism 7, the linear encoder 10, and a paper feeding mechanism 8.

The controller 41 performs each kind of control and also converts the print data inputted from the external apparatus through the external I/F 37, into dot pattern data corresponding to a dot pattern. Then, in a case of obtaining the dot pattern data for one line that can be recorded by one pass of main scanning of the recording head 2, the controller 41 outputs the dot pattern data for one line to the recording head 2 through the internal I/F 45. In addition, as described later, the controller 41 performs drive voltage reset processing.

Figure 4A:
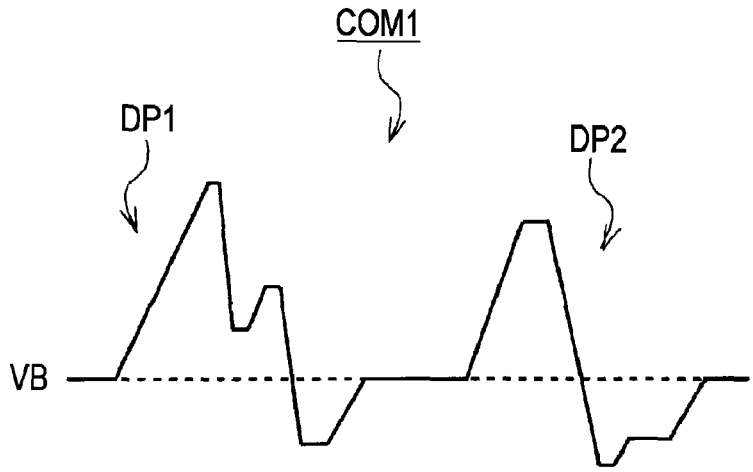
FIG. 4 is a waveform chart explaining the structure of a drive signal.
Figure 4B:
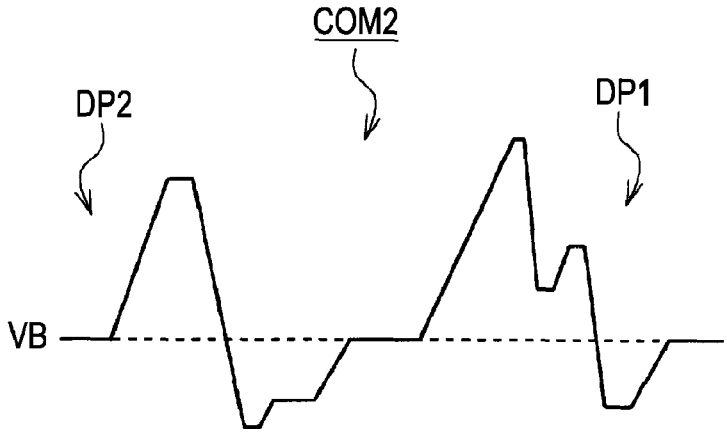

The drive signal generation circuit 43 includes a plurality of drive pulses capable of forming dots of different sizes in one recording period, and generates a forward movement drive signal in which the drive pulses are connected to each other in a prescribed sequence at a forward moving time of the recording head 2, and generates a backward movement drive signal in which the drive pulses are connected to each other in a sequence that is the reverse of that of the forward movement drive signal. For example, as shown in FIG. 4A, a forward movement drive signal COM1 is constituted so as to include a series of signals in which a small dot drive pulse DP1 for discharging an ink droplet of a liquid amount capable of forming a small dot (small dot ink droplet), and an intermediate drive pulse DP2 for discharging an ink droplet of a liquid amount capable of forming an intermediate dot (intermediate dot ink droplet) are sequentially connected. Also, as shown in FIG. 4B, a backward movement drive signal COM2 is constituted so as to include a series of signals in which the intermediate dot drive pulse DP2 and the small dot drive pulse DP1 are sequentially connected to each other.

Figure 5:
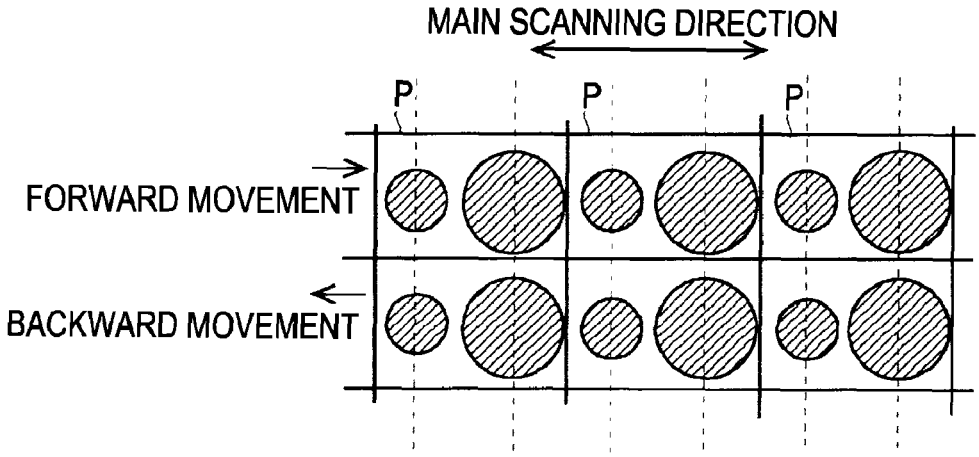
FIG. 5 is a schematic view explaining bidirectional recording.

As shown in FIG. 5, the printer 1 is designed to align an arranged sequence of small dots and intermediate dots formed on a recording paper 6 in the main scanning direction, by using the drive signal COM1 and the drive signal COM2 so as to switch between them in such a manner that the drive signal COM1 is used during forward movement and the drive signal COM2 is used during backward movement. In addition, when pixels (areas surrounded by a solid line in FIG. 5) are arranged along the sub-scanning direction forward movement and backward movement, an application timing of the drive signal to the piezoelectric element 17 is adjusted in advance, so that an impact position of the small dots in the main scanning direction and the impact position of the intermediate dots in the main scanning direction are aligned with each other between pixels. An adjusted value of this application timing is referred to as a Bi-D adjusted value hereafter.

In the printer 1 constituted as described above, the drive voltage of each drive pulse in the aforementioned drive signal is set as a normally used voltage, so that an amount per one droplet of the ink ejected from the nozzle opening 27 coincides with a design value. However, when the printer 1 is used over a long period of time, characteristics of the piezoelectric element 17 are changed with time. Namely, a displacement amount of the piezoelectric element 17 according to an applied voltage is deteriorated. In this case, even when the piezoelectric element 17 is driven with a normally used voltage set at the time of manufacturing the printer, there is a possibility that the amount of the ejected ink is reduced so as to be less than the design value, or the flight speed of the ejected ink is decreased allowing deviation of the impact position in the recording medium to occur.

Therefore, in the printer 1 according to the present invention, the elapsed time from the previous drive voltage setting time (which may be the drive voltage setting time at the time of manufacturing the printer 1) is counted by the timer circuit 44, and under a condition that the elapsed time from the previous drive voltage setting time exceeds the judgment reference time, a mode is switched to a drive voltage resetting mode from a normal mode for performing a normal recording operation, and in this state, the drive voltage reset processing is performed. As the judgment reference, 10,000 hours is set, for example, which is the time taken for the piezoelectric element 17 to suffer deterioration due to a normal use. Such drive voltage reset processing will be explained hereafter.

Figure 6:
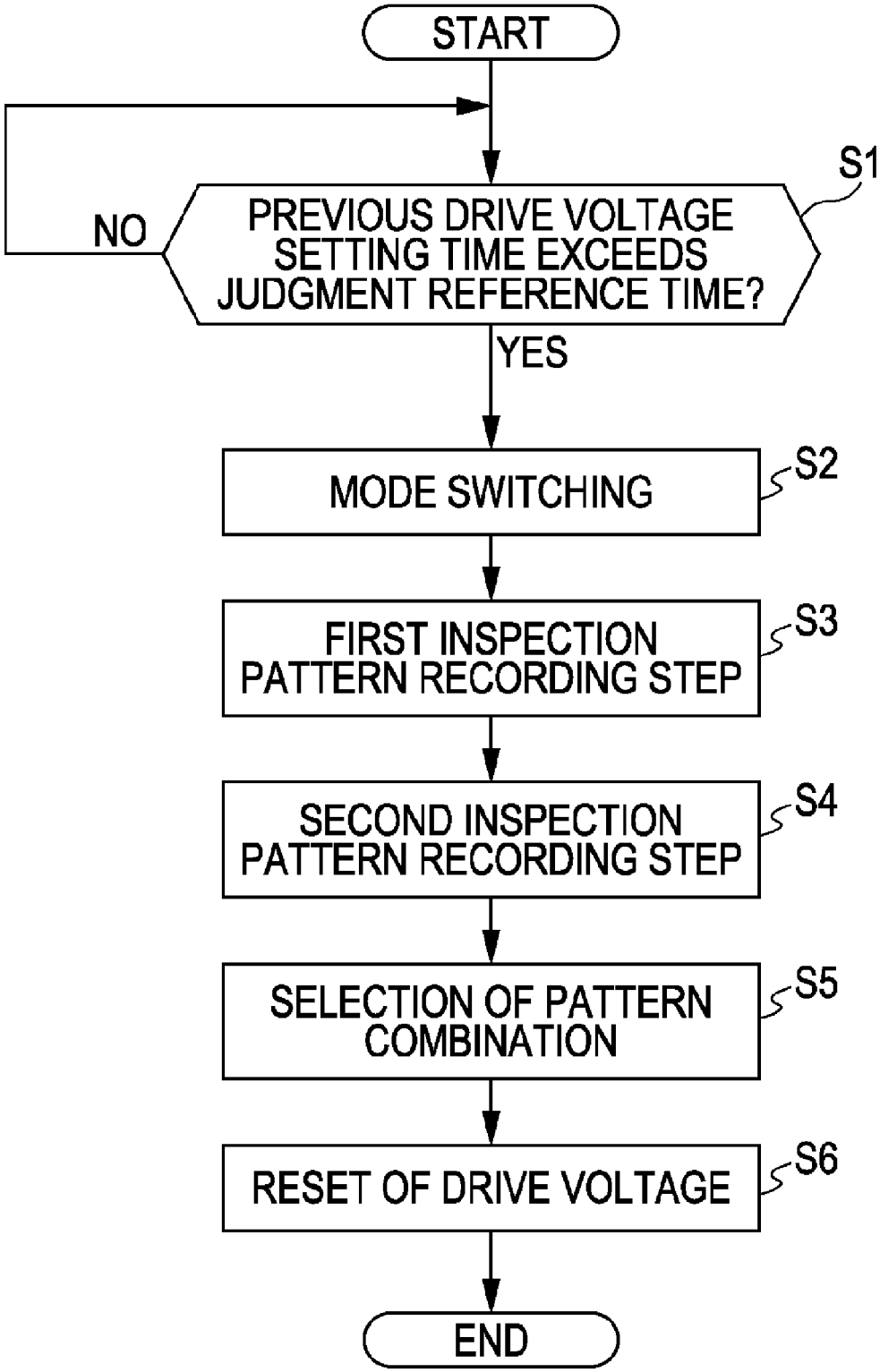
FIG. 6 is a flowchart explaining the flow of drive voltage reset processing.

FIG. 6 is a flowchart explaining a flow of the drive voltage reset processing.

First, the controller 41 monitors the timer circuit 44, and judges whether or not a measurement made by this timer circuit 44 exceeds the judgment reference time (S1), and when the measurement made by the timer circuit 44 does not exceed the judgment reference time, the controller 41 monitors the timer circuit 44 continuously. Meanwhile, when the controller 41 so judges that the measurement made by the timer circuit 44 exceeds the judgment reference time, the controller 41 functions as a mode switching unit in this invention, and performs mode switching from the normal mode to the drive voltage resetting mode (S2). Such a mode switch setting is executed immediately after turning on a power supply of the printer 1, and when the printer 1 is set in a stand-by state, the mode switch setting is executed at this time. When the mode is switched to the drive voltage resetting mode, a first inspection pattern recording step (S3), a second inspection pattern recording step (S4), a pattern combination selecting step (S5), and a drive voltage setting step (S6) are executed as described below.

In the first inspection pattern recording step (S3) the controller 41 controls the print engine 36, and records a plurality of first inspection patterns on the recording paper 6 in the main scanning direction, while moving the recording head 2 in the forward direction. Note that in the steps of recording the inspection patterns (S3, S4), it is preferable to use the drive pulse corresponding to a dot size having the largest influence on the image quality of a recorded image. Namely, as the weight of the ejected ink becomes smaller (as the size of the ink droplet becomes smaller), the ink droplet is more easily influenced by air resistance in a period from being ejected until impacting on the recording medium 6, and a flight deflection due to the decrease of the flight speed is more easily generated. Therefore, in this embodiment, the inspection pattern is recorded by using the small dot drive pulse DP1. Moreover, as will be described later, the voltage of the drive pulse is differentiated, for every combination of the first inspection patterns and the second inspection patterns.

When the first inspection patterns are recorded on the recording medium, a plurality of second inspection patterns (S4) are recorded in the main scanning direction corresponding to the first inspection patterns, at timings when positions of the second inspection patterns in the main scanning direction are theoretically aligned with the positions of each first inspection patterns recorded on the recording medium while moving the recording head 2 in the forward direction (previously set Bi-D adjusted value). The voltage of the drive pulse (small dot drive pulse DP1) in this second inspection pattern recording step is set to the same voltage as the voltage for recording the corresponding first inspection patterns.

Figure 7:
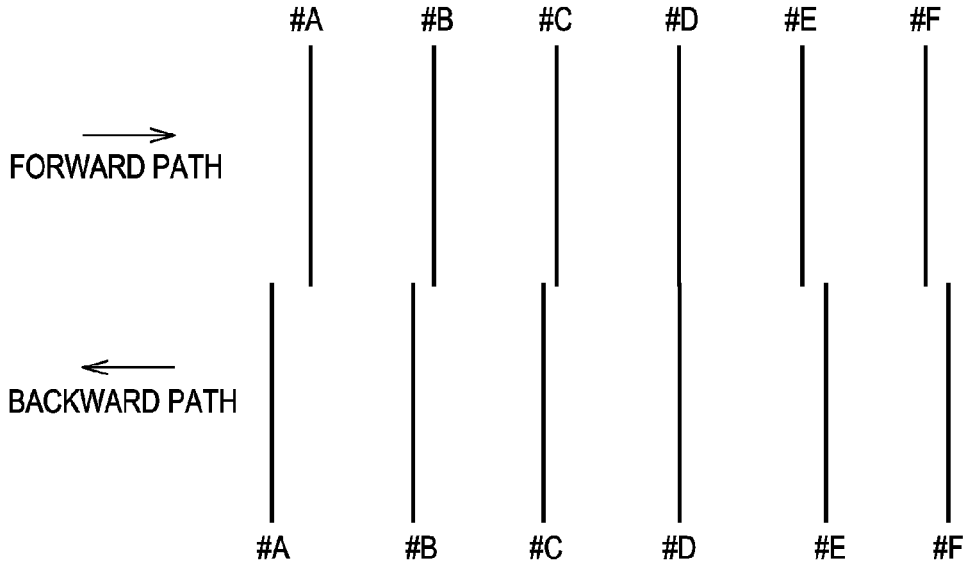
FIG. 7 is a schematic view explaining inspection patterns.

FIG. 7 is a view showing an example of the inspection patterns (the first inspection patterns (upper ruled lines) and the second inspection patterns (lower ruled lines)) formed on the recording paper 6. The inspection patterns in this embodiment are constituted of longitudinal ruled lines formed along the sub-scanning direction by simultaneous ejection of the ink from the nozzle openings 27 of a nozzle row, and a plurality of inspection patterns are formed in the main scanning direction. In the example of FIG. 7, six inspection patterns in total shown by #A to #F are recorded on the recording paper, in each case of the forward moving and the backward moving. In addition, identification information (in this example, #A to #F) for identifying each inspection pattern (the combination of a first inspection pattern and a second inspection pattern) is also recorded on the recording paper 6, corresponding to each inspection pattern.

Here, when each inspection pattern is recorded, the drive voltage of the drive pulse is different for every set of the first inspection patterns and the second inspection patterns, and in this embodiment, the drive voltage for recording a set of #A is set as the normally used voltage set at present, and regarding sets of #B to #F, the drive voltage is increased step by step (by 0.2V, for example), and the drive voltage for recording #F is set highest. Note that in this example, a recording order of the first inspection patterns is an order of #A to #F, and meanwhile an actual recording order of the second inspection patterns is #F to #A. Further, in this embodiment, the drive voltage for recording the set of #A is set as the present normally used voltage. However, the embodiment is not limited thereto, and the drive voltage for recording any one of the combinations may be set as the present normally used voltage. Namely, the normally used voltage set at present may be included in the voltages of the drive pulses which are different for every combination of the first inspection patterns and the second inspection patterns. Accordingly, for example, the drive voltage corresponding to the set of #C is set as the present normally used voltage and regarding the groups of #A and #B, the drive voltage is set lower, step by step than the normally used voltage in an order of #B and #A, and regarding the groups of #D to #F, the drive voltage may be set higher, step by step than the normally used voltage in this order.

Here, when the displacement of the piezoelectric element 17 is changed, the flight speed of the ejected ink (ink droplet) is also fluctuated. Inertia due to a movement of the recording head is applied to the ejected ink, and the ink flies in an oblique direction with respect to a recording surface of the recording medium. Therefore, when the flight speed is fluctuated, the impact position on the recording paper 6 is deviated in the main scanning direction from the impact position before fluctuation. Accordingly, even if at the timings when the positions in the main scanning direction are theoretically aligned at the time of recording the first inspection patterns and at the time of recording the second inspection patterns, the positions of the second inspection patterns with respect to the first inspection patterns in the main scanning direction are different, for every combination of patterns. Namely, by differentiating the drive voltage at the time of recording for every combination of the inspection patterns, the flight speed of the ink is intentionally fluctuated, and the positions of the second inspection patterns with respect to the first inspection patterns in the main scanning direction are differentiated in each set of #A to #F.

When the first inspection patterns and the second inspection patterns are recorded, subsequently the most preferable combination of the first inspection patterns and the second inspection patterns is selected by the judgment of a user (S5). Here, the "most preferable combination" among the combinations of the first inspection pattern and the second inspection pattern is the combination in which the first inspection pattern and the second inspection pattern are arranged in a state in which they come closest to each other. In the example of FIG. 7, the positions of the combination shown by #D in the main scanning direction are arranged on a straight line in a state that they come closest to each other, and this #D is regarded as the most preferable combination. At this time, for example, by a user designating or inputting the identification information (#D) showing the most preferable combination, through driver software and an operation panel of a printer body, an optimal combination is grasped by the controller 41 of the printer 1.

When selection of the combination of the inspection patterns is performed, subsequently, resetting of the drive voltage is performed (S6). In this resetting of the drive voltage, the drive voltage of the drive pulse used for recording the combination of the patterns selected as the most preferable combination is set as the normally used voltage of this drive pulse. Namely, in a case of this embodiment, the drive voltage of the small dot drive pulse DP1 used for recording the group of #D is adopted as the normally used voltage of this small dot drive pulse DP1.

Note that in this embodiment, the reset processing of the drive voltage is performed on the basis of the inspection patterns recorded by using the small dot drive pulse DP1. However, the reset processing of the drive voltage may be similarly performed by using another drive pulse (in a case of this embodiment, the intermediate drive pulse DP2). By applying the reset processing of the drive voltage to all kinds of the drive pulse, an optimal drive voltage can be set, irrespective of the dot size.

As described above, the reset processing of the drive voltage is performed. Thus, it is possible to respond to deterioration (deterioration of the displacement amount) of the piezoelectric element 17 over long-period use. Therefore, an ejection amount of the ink and ejection characteristics of the flight speed and the like can be maintained as designed, thus making it possible to satisfactorily maintain the density of images recorded on recording mediums such as paper and the like. In addition, by allowing the user to visually discriminate positional deviations between the longitudinal ruled lines as the first inspection patterns and the longitudinal ruled lines as the second inspection patterns formed on the recording medium, resetting of the drive voltage can be performed. Thus, the resetting of the drive voltage can be easily performed without separately requiring a special structure (such as a scanner).

Incidentally, the present invention is not limited to the above-described embodiments, and various modifications are possible based on the description in the scope of the claims.

For example, in the above-described embodiments, switching of the mode is given as an example of a mode switching, under the condition that measurement by the timer circuit 44 exceeds the judgment reference time. However, embodiments of the present invention are not limited thereto. For example, it may also be preferable that the controller 41 functions as an ejection number counting unit and counts the number of times of ejection of the ink is performed, and switching of the mode is performed under a condition that a counted value thus obtained exceeds a judgment reference value (such as a billion times). Thus, the mode is switched from the normal mode to the drive voltage resetting mode according to a deterioration state of the piezoelectric element 17, thus making it possible to perform the drive voltage reset processing at a more proper timing.

In addition, regarding switching of the mode, it may also be preferable that when the user recognizes changes in the density and color phase of a recorded image, by operating printer driver software installed in external equipment such as an information processing apparatus (computer), and the operation panel provided in the casing of the printer 1, a mode switching instruction is inputted, and according to this mode switching instruction, the controller 41 switches the mode from the normal mode to the drive voltage resetting mode. Thus, the intention of the user can be reflected in the drive voltage setting timing.

Figure 8:
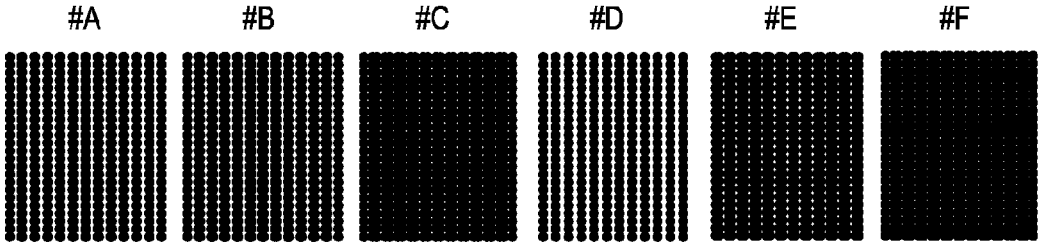
FIG. 8 is a view explaining other embodiments of the inspection patterns.

Further, regarding the inspection patterns, the inspection patterns constituted of the longitudinal ruled lines are shown as examples in the aforementioned embodiments. However, the embodiments are not limited thereto. For example, as shown in FIG. 8, the inspection patterns may also be formed by causing the ink to impact on an area defined in each area of identification information (filling up the areas with dots) during forward moving and during backward moving. In this case, on the basis of the changes in density and feeling of roughness generated according to the deviation between the dots formed during forward moving and the impact position of the dots formed during backward moving, the user selects the most preferable combination. In a case of FIG. 8, regarding #A to #C, #E, and #F, the positions of the dots are deviated at the time of forward moving and at the time of backward moving. Therefore, the area is entirely filled up with dots. Meanwhile, regarding the group of #D, the positions of the dots are overlapped one another at the time of forward moving and at the time of backward moving, thus allowing a gap to be generated between the adjacent dots in the main scanning direction, which appears as a longitudinal streak. Therefore, the group of #D is regarded as the most preferable combination.

In addition, in the above-described embodiments, the piezoelectric element 17 of a so-called vertical oscillation mode is given as an example of the pressure generating unit of the present invention. However, the present invention is not limited thereto. For example, a piezoelectric element may be provided in each pressure generation chamber, like a piezoelectric element of a so-called deflection oscillation mode. Further, it is possible to use not only a piezoelectric element, but also other pressure generating units such as a heating element.

In addition, the present invention can be applied to liquid ejection apparatuses other than the aforementioned printer, provided that the liquid is ejected by utilizing a pressure generating unit. For example, the present invention can also be applied to a display manufacturing apparatus, an electrode manufacturing apparatus, and a chip manufacturing apparatus.

What is claimed is:

1. A liquid ejecting apparatus, comprising:

a liquid ejecting head capable ejecting liquid from a nozzle opening by means of a pressure fluctuation of the liquid in a pressure generation chamber, upon activation of the pressure generating unit; a drive signal generation unit that generates a drive signal including a drive pulse for driving the pressure generating unit; and a controller that controls ejection of the liquid by the liquid ejecting head, the controller forming a plurality of first inspection patterns on a medium in a head moving direction while moving the liquid ejecting head in a forward direction, forming a plurality of second inspection patterns on the medium in the head moving direction so as to correspond to the first inspection patterns formed on the medium while moving the liquid ejecting head in a backward direction, performing drive voltage reset processing for setting a voltage of a drive pulse at the time of patterns corresponding to a preferable combination of the first inspection patterns and the second inspection patterns formed in the inspection pattern steps, as a normally-used voltage used for normal forming, differentiating the voltage of the drive pulse used for forming the inspection patterns, for every combination of the first inspection patterns and the second inspection patterns in the aforementioned drive voltage reset processing, and forming the second inspection patterns corresponding to the first inspection patterns at timings when positions of the second inspection patterns in the head moving direction are theoretically aligned with the positions of the first inspection patterns.

2. The liquid ejecting apparatus according to claim 1, wherein a presently set normally used voltage is included in the voltages of the drive pulse that is different for every combination of the first inspection patterns and the second inspection patterns.

3. The liquid ejecting apparatus according to claim 1, wherein the liquid ejecting head has a nozzle group formed by arranging nozzle openings in a plurality of rows in a direction orthogonal to the head moving direction, and each inspection pattern is constituted of longitudinal ruled lines formed by simultaneous ejection of the liquid from the nozzle openings of the nozzle group, and a preferable combination is a combination in which the first inspection pattern and the second inspection pattern are arranged in a state that they come closest to each other.

4. The liquid ejecting apparatus according to claim 1, further comprising a mode switching unit capable of switching between a normally forming mode in which normal forming operation is performed and a drive voltage resetting mode in which drive voltage reset processing is performed, wherein the controller performs the drive voltage reset processing when the mode is switched to the drive voltage resetting mode by the mode switching unit.

5. The liquid ejecting apparatus according to claim 4, further comprising a timer unit that measures an elapsed time from the previous drive voltage setting time, wherein the mode switching unit switches a mode to the drive voltage resetting mode, under a condition that the elapsed time from the previous drive voltage setting time exceeds a judgment reference time.

6. The liquid ejecting apparatus according to claim 4, comprising an ejection number counting unit that counts the number of times that ejection of liquid has been performed, wherein the mode switching unit switches the mode to the drive voltage resetting mode, under the condition that a value counted by the ejection number counting unit exceeds the judgment reference value.

7. The liquid ejecting apparatus according to claim 4, further comprising an instruction input unit into which a mode switching instruction is inputted by a user, wherein the mode switching unit switches the mode to the drive voltage resetting mode according to the mode switching instruction from the instruction input unit.

* * * * *